United States Patent [19]

Voelz

[11] 3,990,490

[45] Nov. 9, 1976

[54] LIQUID-DISPENSING NOZZLE ASSEMBLY AND SEALING DEVICE

[75] Inventor: Frederick L. Voelz, Orland Park, Ill.

[73] Assignee: Atlantic Richfield Company, Philadelphia, Pa.

[22] Filed: Mar. 31, 1975

[21] Appl. No.: 563,931

[52] U.S. Cl. ..... 141/311 R; 277/106

[51] Int. Cl.[2] ..... B65B 3/18

[58] Field of Search ..... 141/1, 5, 52, 59, 97, 141/285, 287, 290, 311, 312, 367, 368, 372, 382–386, 392; 277/87, 88, 89, 96, 106, 935 D

[56] References Cited

UNITED STATES PATENTS

| | | | |
|---|---|---|---|
| 2,871,039 | 1/1959 | Payne | 277/87 X |
| 3,027,165 | 3/1962 | Kempff et al. | 277/88 X |
| 3,042,414 | 7/1962 | Tracy | 277/87 X |
| 3,840,055 | 10/1974 | Wostl et al. | 141/52 X |

*Primary Examiner*—Richard E. Aegerter
*Assistant Examiner*—Frederick R. Schmidt
*Attorney, Agent, or Firm*—Thomas J. Clough

[57] ABSTRACT

An improved liquid-dispensing nozzle and more specifically, an improved vapor recovery means for a nozzle comprising a vapor collector surrounding a portion of the discharge spout in spaced relation thereto, one end of which is sealed to the upper portion of the nozzle housing or in proximity thereto; and at the other end of the vapor collector, a compressible cellular plastic material overlay on an equalizer means associated therewith. When the discharge spout is inserted into, e.g., an automobile fillpipe, the compressible cellular plastic material forms a vapor seal with the upper end of the fillpipe whereby the vapors escaping from the fillpipe are directed into the interior chamber formed between the exterior of the discharge spout and the inside of the vapor collector thereby minimizing the escape of vapors to the atmosphere. The vapors are then removed from this chamber. Also disclosed is a sealing device for use with a liquid dispensing nozzle assembly including a nozzle housing with an elongated discharge spout and a flexible vapor collector surrounding the spout with one free end and the other end attached to the upper portion of the nozzle housing or in proximity thereto and provided with a means to recover vapor during delivery of liquid from the spout to a liquid receiver inlet including a mounting means affixed to the free end of the vapor collector, a sealant material means affixed to the free end of the vapor collector for contact with the receiver inlet, and an equalizer means affixed to the mounting means and interposed between the mounting means and the sealant material means so as to urge the sealant material means toward the receiver inlet when the spout is inserted in the receiver inlet.

26 Claims, 8 Drawing Figures

LIQUID-DISPENSING NOZZLE ASSEMBLY AND SEALING DEVICE

The present invention relates to a nozzle and sealing device for dispensing a liquid, and more particularly to a nozzle having means for preventing the escape of vapors during a liquid dispensing operation.

Normally, as a fuel such as gasoline is being supplied through a fuel-dispensing nozzle to, for example, an automobile fuel tank, fuel vapor escapes from the fuel tank fill-pipe, this vapor of course adding to the already pressing air pollution problem. Such air pollution is increasingly becoming a cause of concern and numerous governmental jurisdictions are requiring control of causes of air pollution. An increasing number of jurisdictions are requiring minimization of escape of both liquid fuel and fuel vapor from vehicles which are being supplied with fuel. Reducing the fuel delivery rate, while reducing liquid-splash-back, does not prevent escape of vapors and in fact, because of the longer time required to fill the vehicle fuel tank, may increase the escape of fuel vapors lost during the filling of the tank.

The prior art has suggested various means of recovering vapors which otherwise would escape to the atmosphere while fuel tanks are being filled. For example, U.S. Pat. No. 3,581,782 discloses a vapor emission control system suitable for gasoline and other fuel delivery systems, and adapted to eliminate the escape of fuel vapors to the atmosphere. The disclosed embodiment of the control system includes, for example, a flexible annular sleeve surrounding the spout of the nozzle and sealed to the fillpipe of the fuel tank by means of an expandible member which, when expanded after the spout is inserted into the fillpipe, prevents the emission of vapor to the atmosphere.

Similarly, U.S. Pat. No. 3,566,928 discloses a vapor seal for fuel dispensing nozzles wherein the forward end (i.e., the end opposite the main housing of the nozzle) of the flexible bellows which surrounds the spout is sealed to the fillpipe by means of an annular-shaped magnetic rubber sealing assembly.

It is known also in the prior art simply to employ a flexible means surrounding the spout, such as the flexible bellows by itself. In this case, when the discharge spout is inserted into the fillpipe, the flexible bellows is compressed and tends to seal itself to the upper portion of the fillpipe. However, this seal between the forward or heel portion of the bellows and the upper portion of the fillpipe is not a good one, and hence the above-noted prior art suggestion for using magnetic rubber means.

Reference is also made to U.S. Pat. Nos. 2,850,049 and 2,908,299 for fuel vapor recovery systems.

There is therefore a need for a simple and effective device for sealing a vapor collection device to the upper portion of, for example, an automobile fillpipe. Specifically, there is a need for improving the seal that is possible between, for example, the flexible bellows of the prior art and the upper portion of an automobile fuel tank fillpipe.

It is therefore a primary object of the present invention to provide a sealing device for a liquid-dispensing nozzle provided with vapor recovery means.

It is a further object of the present invention to provide a liquid fuel-dispensing nozzle wherein the seal between the vapor collecting means and the automobile fuel tank fillpipe is improved.

It is yet a further object of the present invention to provide such an improved sealing means which is simple in design.

Other objects and advantages will become apparent to those skilled in the art from the ensuing description.

SUMMARY OF THE INVENTION

The present invention accomplishes the above objects and others by utilizing, a sealing device for use with a liquid dispensing nozzle assembly having a nozzle housing with an elongated discharge spout and a flexible vapor collector surrounding the spout with one free end and the other end attached to the nozzle housing or in proximity thereto and provided with a means to recover vapor during delivery of liquid from the spout to a liquid receiver inlet which comprises a mounting means affixed to the free end of the vapor collector, a sealant material means affixed to the free end of the vapor collector for contact with the receiver inlet, and an equalizer means affixed to the mounting means and interposed between the mounting means and the sealant material means so as to urge the sealant material means toward the receiver inlet when the spout is inserted in the receiver inlet. In another preferred embodiment, a compressible cellular plastic material is used as the sealant material means to engage the upper portion of, for example, the automobile fuel tank fillpipe. The use of the compressible cellular plastic material provides a greatly improved seal between the vapor collector means, preferably a flexible bellows, and the fillpipe.

DETAILED DESCRIPTION OF THE INVENTION

The improved vapor recovery apparatus and sealing device of the present invention is particularly useful with conventional liquid fuel-dispensing nozzles, and while the present invention is applicable to all liquid-dispensing nozzles, it is particularly useful with liquid fuel (e.g., gasoline) nozzles, and the present invention will therefore be described with reference to the latter, although those skilled in the art will realize that the invention generally is applicable to a much broader field.

A liquid fuel-dispensing nozzle comprises a main body or housing having an integral handle, a fuel inlet which normally comprises a flexible conduit means communicating between the source of fuel such as an underground storage tank, and a discharge spout which is adapted for insertion into the fillpipe of the fuel tank. A latch means is usually provided around a major portion of the discharge spout. The latch means assists in holding the spout in the fillpipe during the filling operation, especially during self-serve operations.

As pointed out above, the prior art has suggested that a vapor collecting device, such as a flexible bellows, be employed to surround a major portion of the discharge spout. The bellows is sealed to the housing at the upper end of the spout and terminated in free end including a heel-portion which is generally annular in shape and has a flat face for contacting the upper portion of the fillpipe. As the spout is inserted into the fillpipe, the bellows is compressed and the heel portion forms a seal with the upper portion of the fillpipe.

The free end carries a sealing device on its heel portion. According to the invention, this includes a sealant material means to contact the fillpipe and an equalizer means to allow for conformation with the fillpipe. The equalizer means allows conformation to both overall angle of the fillpipe face and to unlevel portions of the fillpipe, for example, dents.

Moreover, in a preferred embodiment of the present invention, a compressible cellular plastic material, such as a foamed synthetic resin cellular plastic, is carried by or secured to the heel portion of the bellows and it is this compressible cellular plastic material which contacts the fillpipe. It has been found that such material greatly improves the seal between the flexible bellows and the fillpipe and improves the reduction in the amount of vapors escaping to the atmosphere. Suitable means is provided for removing the vapors from the interior of the bellows, as is conventional.

Figures 1, 5, 6:
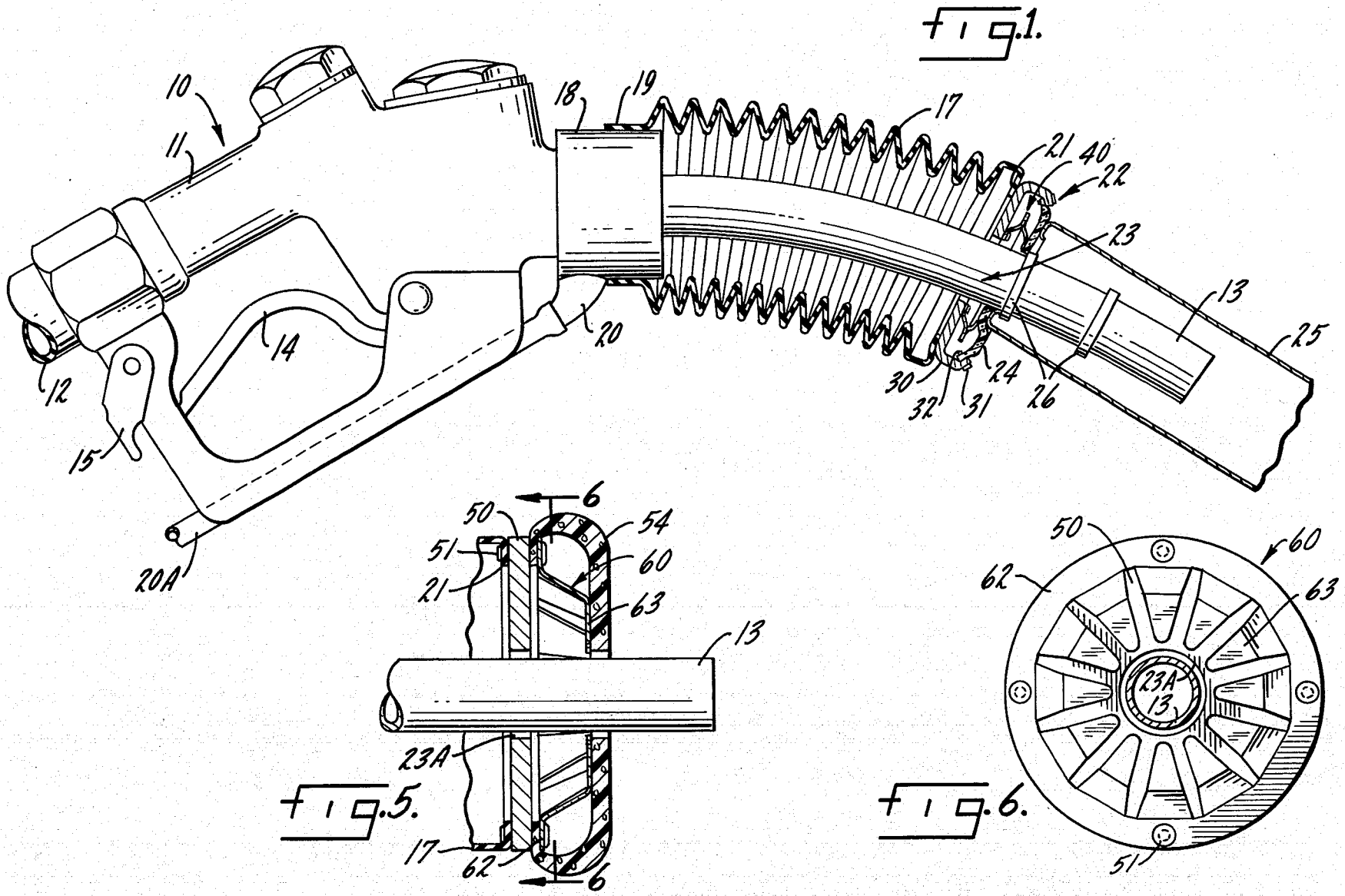
FIG. 1 is a side view, partly in cross-section, of an improved fuel-dispensing nozzle and sealing device of the present invention inserted into a fillpipe of an automobile fuel tank.
FIG. 5 is a cross-section view of still another embodiment of a sealing device of the instant invention.
FIG. 6 is a partial elevation of an equalizer means of FIG. 5 taken approximately on line 6—6.

Referring now to FIG. 1, a gasoline-dispensing nozzle is shown which is provided with vapor recovery means inserted into a gasoline fillpipe and latches so that the bellows is compressed. More specifically, a nozzle generally designated 10 comprises a main body or housing 11, an inlet conduit 12 and a discharge spout 13. A handle 14 is provided for actuating the delivery of gasoline or other liquid fuel. In addition, and as is conventional, a retainer means 15 is also provided on the main body of the housing for holding the handle 14 in its fuel-delivery position. It is also conventional to provide such nozzles with means for automatically shutting off delivery of fuel when the fuel tank or fillpipe is full. Such means are not shown in FIG. 1, but may include an orifice near the discharge outlet of the spout 13, and a tube communicating from the orifice to a control mechanism within the main body 11 of the nozzle, wherein the control mechanism, sensing the presence of a gas or liquid near the orifice, acts to disengage handle 14 from retainer 15 thereby automatically stopping delivery of fuel through the nozzle.

The major portion of spout 13 is surrounded by a flexible vapor collector which may take the form of a flexible bellows 17. The upper end 19 of bellows 17 is sealed to surface 18 of the nozzle. The opposite end or free end of bellows 17 comprises a heel portion 21 and, according to the present invention, a sealing device 22 is carried by or secured to heel portion 21. Both heel portion 21 and sealing device 22 are substantially annular in shape providing a space indicated approximately by arrow 23 beteen the same and the outside surface of spout 13, allowing vapors escaping from the fillpipe to pass therebetween and into the interior of bellows 17. An aperture 20 is conveniently provided near the upper end of the bellows 17 for removal of vapors. The means for removing the vapors from aperture 20 is not per se included within the scope of the present invention, but may comprise, for example, a flexible tubing 20A attached to aperture 20, flexible tubing 20A communicating with, for example, a combustion means whereby the vapors may be rendered harmless. Alternatively, the hydrocarbons in the vapors may be recovered by other suitable means such as by adsorption or condensation.

Figure 2:
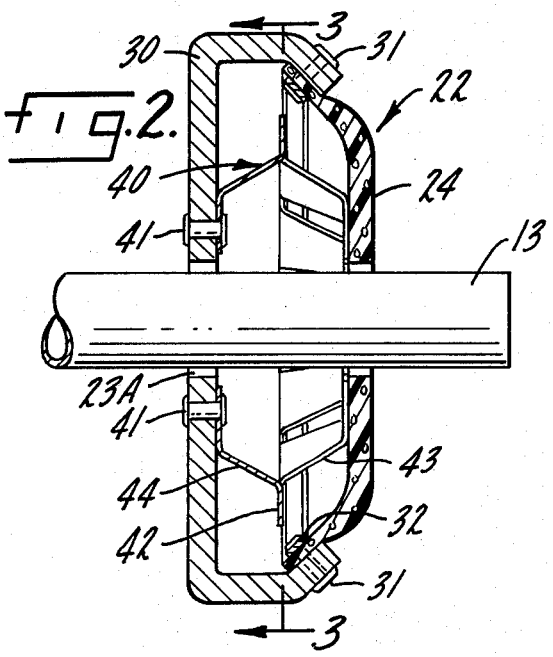
FIG. 2 is a cross-section view of the sealing device of FIG. 1.
Figure 3:
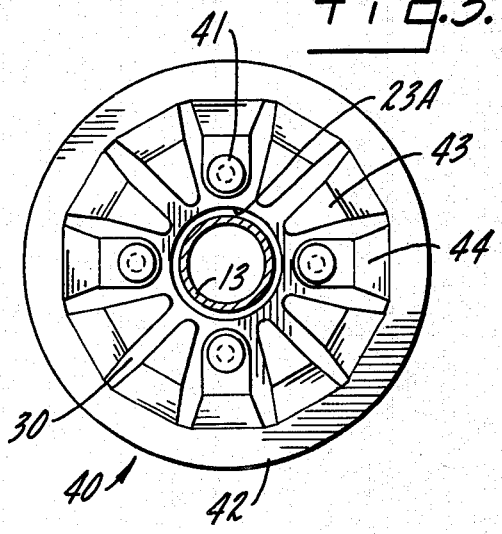
FIG. 3 is a partial elevation of an equalizer means of FIG. 2 taken approximately on 3—3.

Sealant material means 24 of sealing device 22 is the surface which contacts the fillpipe, reference being made to FIGS. 2 and 3 which show enlarged views of the sealing device. Spout 13 is shown inserted into a fillpipe 25, the upper portion of the latter contacting sealant means 24 of sealing device 22 thereby sealing the same against vapor escape. Spout 13 is shown as being provided with a latch means 26 which assists in maintaining the spout in the fillpipe during the filling operation. Latch 26 is preferably of square cross-section although a round cross-section is satisfactory. In operation, as the spout is inserted into the fillpipe, the latch means acts to retain the same therein. As spout 13 is forced into the fillpipe, bellows 17 is compressed and as spout is held therein by means of latch 26, sealant material means 24 of sealing device 22 tightly seals the fillpipe against possible vapor loss. Vapors which leave fillpipe 25 pass through space 23A into the interior of bellows 17 from which they are removed through aperture 20.

Referring now to FIG. 2, it can be seen that sealing device 22 includes a mounting means 30 which is affixed to heel portion 21 of bellows 17. The sealant material means 24 is affixed to mounting means 30 by rivets 31 or other suitable fastening devices, for instance a fastening bracket 332 may be utilized with rivets 31 so as to provide a wide area of contact for affixing sealant material means 24. Equalizer means 40 is affixed to mounting means as desired so that it is interposed between mounting means 30 and sealant material means 24 so as to urge the sealant material means toward a receiver inlet when spout 13 is inserted into the receiver inlet. As in FIG. 1 it can be seen that equalizer means 40 presses or urges sealing material means 24 against fillpipe 25.

Turning to FIG. 3, it is seen that equalizer means 40 includes a ring 42 with a plurality of resilient prongs 43 which extend toward the sealant material means 24. The ring also includes a plurality of resilient prongs 44 which extend downward to and are fastened to mounting means 30. Space 23A between nozzle 13 and mounting means 30 allows flow of vapors into bellows 17 from the sealing device.

Figure 4:
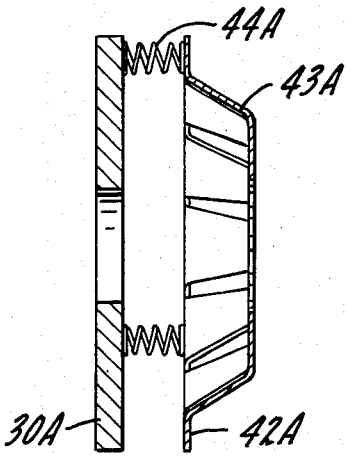
FIG. 4 is a cross-section view of another embodiment of a sealing device of the instant invention.

Turning to FIG. 4, a partial sectional portion of mounting means 30A is shown which has affixed to it mounting springs 44A which are affixed on the other end to ring 42A which has upwardly extending from it toward a sealant material means not shown resilient prongs 43A. The sealant material and its attachment to mounting means 30A or ring 42A have been omitted for brevity, however, will operate similarly to the sealing device of FIGS. 1, 2 and 3.

When sealing device 22 is urged against the top surface of the fillpipe, the upward extending prongs 43 and 43A will conform to the geometry of the fillpipe and in particular will improve the conforming to dented or unlevel portions of the fillpipe. The downward extending prongs 44 or the springs 44A will help the overall sealing device conform to the plane of a fillpipe which is not perpendicular to the axis of spout 13. Of course, the two modes of conformation may very well combine with and aid each other. For example, if an extremely large unlevel spot on the fillpipe exists, a downward extending prong 44 or spring 44A would help compensate for this problem and help the sealant material means to conform to the fillpipe surface. Similarly, the upward extending prongs 43 and 43A may help the sealant material to conform to an unperpendicular plane of a fillpipe.

Another embodiment of a sealing device is shown in FIGS. 5 and 6. Equalization means 60 comprises a outer ring 62 which is attached to a mounting means 50 by rivets or fasteners 51. Mounting means 50 is in turn attached to heel portion 21 of a bellows 17. Fasteners 51 also attach a sealant material means 54 to mounting means 50. Again equalizer means 60 is interposed between mounting means 50 and sealing material means 54 when spout 13 is inserted into a fillpipe. Equalizer means 60 includes a plurality of upward extending resilient prongs 63 which will provide a conforming action when urged against said sealant material 54. Of course, if it were desired, an additional spring means could be interposed between ring 62 and mounting means 50 to provide for a secondary mode of conforming action, however this is not necessary in all cases, since by using the principles of the instant invention, adequate seals can be obtained with any of the embodiments of this invention.

Figure 7:
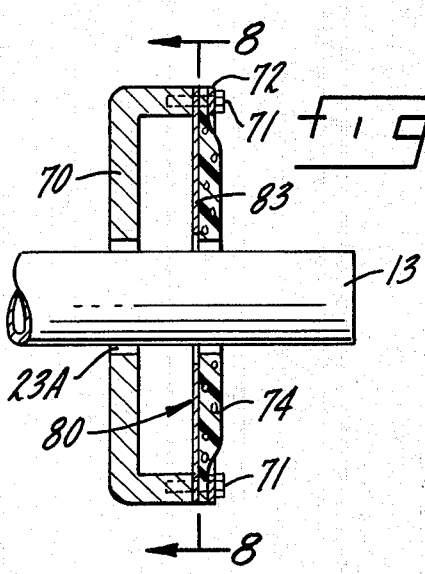
FIG. 7 is a cross-section view of a different embodiment of a sealing device of the instant invention; and, FIG. 8 is a partial elevation of an equalizer means of FIG. 7 taken approximately on line 8—8.
Figure 8:
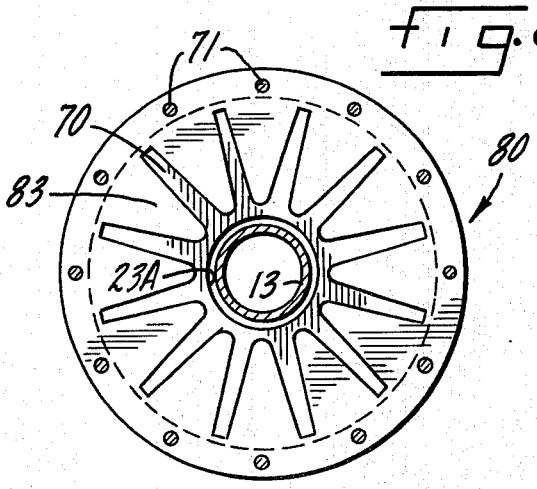

Still another embodiment of the instant invention is shown in FIGS. 7 and 8. Mounting means 70 is affixed to a heal portion of a bellows (not shown). Equalizer means 80 is attached to mounting means 70 by means of screws or other fastening devices 71. Fastening devices 71 may also fasten retaining bracket 72 against mounting means 70 thereby fastening sealant material means 74 to mounting means 70. In this embodiment, flexible prongs 83 extend inwardly toward spout 13 and are position so that when sealant material means 74 is urged against a fillpipe, they will have enough clearance when pushed toward mounting means 70 to allow the sealant material means to conform to the geometry of the fillpipe.

The equalizer means must be made of a flexible or resilient material which has a memory. In particular, some examples are stainless steel or other springy type metals which are preferably resistent to the environmental elements they will encounter. Mounting means 30 is made preferably from a rigid or semi-rigid material which is much less flexible than equalizer means. Sealant material means is made of a resilient material which is much more flexible than either the equalizer means or the mounting means and preferably is made from a compressible cellular plastic material.

While the embodiments have been described with the sealant material means being affixed to a mounting means, the mounting means may in fact be the heel of the bellows and the exact attachment points of the equalizer means, sealant material means and mounting means to each other or the bellows is not critical to the invention as long as the functional arrangement disclosed is maintained. In this regard, the sealant material may be affixed to the equalizer means if desired, for example by being adhered to some or all of the prongs.

Thus, compressible cellular plastic material may be secured to the heel portion 21 of the bellows by any suitable means, for example, an epoxy-type cement can also be employed for this purpose, but those skilled in the art will realize than any adhesive means or fastening means may be employed for this purpose. Of course, the flexible bellows and compressible cellular plastic material must be formed of materials which are substantially resistant to the fuel liquid and vapor being dispensed. For example, the bellows may be comprised of a flexible polychloroprene rubber (i.e., neoprene), such bellows being commercially available. The compressible cellular plastic is defined as a cellular plastic material which is compressible under a normal load (in psi.) obtained when the compressible cellular plastic contacts the fillpipe during the dispensing of fuel. The term "compressible" is used in its normal dictionary sense and includes materials which deform to a certain extent when the spout of the nozzle is inserted into the fillpipe, thereby providing an extremely good seal against vapor escape. Typically, the compressible cellular plastic material is compressed under such normal load in the range of from about 5 to about 85%, more preferably from about 25 to about 70% based upon the original volume of material. Typically, examples of the compressible cellular plastic material are the cellular material (i.e., foams) obtained from polychloroprene latex, polyethylene, silicone, urethane polymer, poly (vinyl chloride), polytetrafluoroethylene, cellulose acetopropianate, urea-formaldhyde resin, fluorine containing elastomers (i.e., fluorosilicons, and fluorohydro carbons) nitrile elastomers, polyacrylic elastomers, and epichlorohydrine containing elastomers. Particularly preferred compressible cellular plastic materials are fluorine containing elastomers, epichlorohydrin elastomers, polyacrylic elastomers and nitrile elastomers. Such compressible cellular plastic material should be substantially resistant toward the fuel liquid being dispensed and the corresponding vapor, particularly when such fuel is gasoline.

The exposed face of the compressible cellular plastic material can be coated with the same plastic material used to form the cellular plastic material. Thus, the face can have a surface skin or coating which contacts the reciever inlet to which liquid is being dispensed. In addition, the face of the compressible cellular plastic material can have a surface skin or coating which is of a different material such as a synthetic resinous material or a natural occurring material, both of which are substantially resistant to fuel liquid and vapor being dispensed. The coating material, either the same or different from the compressible cellular plastic material, has to be resilient, that is, the material deforms to a certain extent when the spout of the nozzle is inserted into the fuel pipe. Typical examples of resilient material are leather and synthetic resin such as fluorine containing elastomers. It is contemplated within the scope of this invention that the term "compressible cellular plastic material" includes such coating or different resilient material affixed thereto to form the exposed face seal.

The thickness of the compressible cellular plastic material is not critical, and may vary from a minimum thickness required to provide the minimum seal to a maximum thickness which would be dictated by economic considerations (i.e., an extremely thick material would not be required). Typically, the compressible cellular plastic material is utilized in a thickness which may range from about 1/16 inch to about ½ inch.

The improved vapor sealing device of the present invention can be employed with any liquid-dispensing nozzle. Although the system of the present invention has been disclosed with reference to a fuel delivery system, particularly a gasoline delivery system, the nozzle assembly of the present invention can be used to prevent escape of vapors in systems for the delivery of liquids other than fuels. Accordingly, it is seen that in accordance with the present invention a nozzle assembly is provided for the delivery of liquids and including means for substantially preventing escape to the atmosphere of vapor during such delivery.

While this invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. A sealing device for use with a liquid dispensing nozzle assembly having a nozzle housing with an elongated discharge spout and a flexible vapor collector surrounding the spout with one free end and the other end attached to the nozzle housing or in proximity thereto and provided with a means to allow for vapor removal during delivery of liquid from the spout to a liquid receiver inlet which comprises:

a sealing device carried by the free end of the vapor collector for forming a surface seal against the outer surface of said receiver inlet; said sealing device comprising mounting means located adjacent to the free end of the said vapor collector and sealant material means adjacent thereto for contacting the surface of said receiver inlet, said spout extending beyond the end of said sealant material;

compressible equalizer means interposed between said mounting means and said sealant material means so as to urge said sealant material means toward said receiver inlet when said spout is inserted into and said sealant material contacts said receiver inlet, provided that said equalizer means substantially regains its original configuration after removal of the spout from the receiver inlet, and the compression of a part of the equalizer means by contact with a part of the surface of the receiver inlet does not substantially reduce the force exerted by another part of the equalizer means against the sealant material when the spout and the receiver inlet are not axially aligned at the sealant material receiver inlet interface, during such contact.

2. A sealing device as in claim 1 wherein said equalizer means comprises a ring with a plurality of resilient prongs which urges said sealant material means towards said receiver inlet when said spout is inserted in said receiver inlet.

3. A sealing device as in claim 2 wherein said ring is affixed to said mounting means.

4. A sealing device as in claim 2 wherein said ring is affixed to said mounting means by a plurality of resilient prongs.

5. A sealing device as in claim 2 wherein said ring is affixed to said mounting means by a plurality of springs.

6. A sealing device as in claim 5 wherein said springs are coil springs.

7. A sealing device as in claim 2 wherein said resilient prongs extend away from said mounting means and toward said sealant means.

8. A sealing device as in claim 1 wherein said sealant means is constructed from a compressible cellular plastic material and the liquid is a fuel.

9. A sealing device of claim 8 wherein said compressible cellular plastic material is obtained from a polymer selected from the group consisting of polychloroprene latex, polyethylene, silicone, urethane polymer, poly (vinyl chloride), polytetrafluoroethylene, cellulose acetopropianate, a urea-formaldehyde resin, fluorine containing elastomers, nitrile elastomers, epichlorohydrin containing elastomers, and polyacrylic elastomers.

10. A sealing device of claim 8 wherein the compressible cellular plastic material is obtained from a polymer selected from the group consisting of fluorine containing elastomers, nitrile elastomers, epichlorohydrin containing elastomers, and polyacrylic elastomers and the material is compressible under normal loads in the range of from 5 to 85% of its original volume.

11. A sealing device of claim 8 wherein the exposed surface face of the compressible cellular plastic material comprises an additional sealant material.

12. A sealing device assembly of claim 11 wherein said additional material is leather.

13. In a liquid dispensing nozzle assembly for delivery of liquid from a liquid source to a liquid receiver having an inlet, said assembly being provided with means to allow for the removal of vapor during delivery of liquid to said receiver inlet from said source, said nozzle assembly comprising:

a liquid dispensing nozzle having a nozzle inlet, a nozzle housing and an elongated discharge spout adapted for insertion into said receiver inlet;

a flexible vapor collector surrounding, in space relation thereto and forming a chamber therearound, the upper portion of said spout nearest said nozzle housing, said chamber being in fluid communication with the receiver inlet when said spout is inserted into said liquid receiver, one end of said vapor collector being sealed to said nozzle housing or in proximity thereto, a sealing device carried by the free end of said vapor collector for forming a surface seal against the outer surface of said receiver inlet, said spout extending beyond the other end of said sealing device;

means for removing vapor from said chamber, said sealing device comprising mounting means located adjacent to the free end of the said vapor collector and sealant material means adjacent thereto for contacting the surface of said receiver inlet, said spout extending beyond the end of said sealant material;

compressible equalizer means interposed between said mounting means and said sealant material means so as to urge said sealant material means toward said receiver inlet when said spout is inserted into and said sealant material contacts said receiver inlet, provided that said equalizer means substantially regains its original configuration after removal of the spout from the receiver inlet, and the of a part of the equalizer means by contact with a part of the surface of the receiver inlet does not substantially reduce the force exerted by another part of the equalizer means against the sealant material when the spout and the receiver inlet are not axially aligned at the sealant material receiver inlet interface, during such contact.

14. A liquid dispensing nozzle assembly as in claim 13 wherein said equalizer means comprises a ring with a plurality of resilient prongs which contact said sealant material means when said spout is inserted in said receiver inlet.

15. A liquid dispensing nozzle assembly as in claim 14 wherein said ring is affixed to said mounting means.

16. A liquid dispensing nozzle assembly as in claim 14 wherein said ring is affixed to said mounting means by a plurality of resilient prongs.

17. A liquid dispensing nozzle assembly as in claim 14 wherein said ring is affixed to said mounting means by a plurality of springs.

18. A liquid dispensing nozzle assembly as in claim 17 wherein said springs are coil springs.

19. A liquid dispensing nozzle assembly as in claim 14 wherein said resilient prongs extend away from said mounting means and toward said sealant means and the liquid is a fuel.

20. A liquid dispensing nozzle assembly as in claim 13 wherein said sealant means is constructed from a compressible cellular plastic material and the liquid is a fuel.

21. A liquid dispensing nozzle assembly as in claim 20 wherein said compressible cellular plastic material is obtained from a polymer selected from the group consisting of polychloroprene latex, polyethylene, silicone, urethane polymer, poly(vinyl chloride), polytetrafluoroethylene, cellulose acetopropianate, a urea-formaldehyde resin, fluorine containing elastomers, nitrile elastomers, epichlorohydrin containing elastomers, and polyacrylic elastomers.

22. A liquid dispensing nozzle assembly as in claim 20 wherein the compressible cellular plastic material is obtained from a polymer selected from the group consisting of fluorine containing elastomers, nitrile elastomers, epichlorohydrin containing elastomers and polyacrylic elastomers and the material is compressible under normal loads in the range of from 5 to 85% of its original volume.

23. A liquid dispensing nozzle assembly of claim 20 wherein the exposed surface face of the compressible cellular plastic material comprises an additional sealant material.

24. A liquid dispensing nozzle assembly of claim 23 wherein said additional sealant material is leather.

25. A liquid dispensing nozzle assembly of claim 13 wherein said mounting means is an integral part of said vapor collector.

26. A liquid dispensing nozzle assembly of claim 25 wherein said vapor collector is a bellows.

* * * * *

UNITED STATES PATENT OFFICE

CERTIFICATE OF CORRECTION

Patent No. 3,990,490 Dated November 9, 1976

Inventor(s) Frederick L. Voelz

It is certified that error appears in the above-identified patent and that said Letters Patent are hereby corrected as shown below:

Column 8, claim 13, line 60, after the "the", first occurrence only, insert the word -- compression --.

Signed and Sealed this

Eighth Day of February 1977

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 3,990,490

DATED : November 9, 1976

INVENTOR(S) : Frederick L. Voelz

It is certified that error appears in the above-identified patent and that said Letters Patent are hereby corrected as shown below:

Column 7, claim 7, line 68, after the word "means" and before the period (.), insert -- and the liquid is a fuel --.

Signed and Sealed this

Eighth Day of March 1977

[SEAL]

*Attest:*

RUTH C. MASON
*Attesting Officer*

C. MARSHALL DANN
*Commissioner of Patents and Trademarks*